United States Patent [19]

Kashiwabara et al.

[11] 4,330,770

[45] May 18, 1982

[54] MAGNETICALLY CONTROLLED SWITCHING DEVICE

[75] Inventors: Hirotaka Kashiwabara; Mamoru Shirai; Shinichi Inoue, all of Kawasaki, Japan

[73] Assignee: Fujitsu Limited, Kawasaki, Japan

[21] Appl. No.: 101,689

[22] Filed: Dec. 10, 1979

[30] Foreign Application Priority Data

Dec. 15, 1978 [JP] Japan ..... 53/173267[U]

[51] Int. Cl.[3] ..... H01H 67/30; H01H 63/33

[52] U.S. Cl. ..... 335/112; 335/152

[58] Field of Search ..... 335/152, 112; 340/166 R, 166 S

[56] References Cited

U.S. PATENT DOCUMENTS

| | | | |
|---|---|---|---|
| 3,439,301 | 4/1969 | Kudo et al. | 335/112 |
| 3,982,216 | 9/1976 | Mitsuhashi et al. | 335/112 |
| 4,019,164 | 4/1977 | Deeg | 335/112 |

*Primary Examiner*—L. T. Hix
*Assistant Examiner*—S. D. Schreyer
*Attorney, Agent, or Firm*—Staas & Halsey

[57] ABSTRACT

A magnetically controlled switching device having a magnetic shunt plate with many terminals arrayed along the peripheral portions thereof, a plurality of coil forms located at the crosspoints of a matrix consisting of X and Y coordinates on a plane surrounded by the terminals on the magnetic shunt plate, an X coil control line wound on each of the coil forms in the row in the X direction in an alternately reversed manner, both ends of the X coil line being connected to corresponding terminals located along the X direction, a Y coil control line wound on each of the coil forms in the column in the Y direction in an alternately reversed manner, both ends of the Y coil control line being connected to corresponding terminals located along the Y direction, reed switches accommodated in each of the coil forms, contact points of the reed switches corresponding to the magnetic shunt plate, and the reed switches being connected to a plurality of matrix crosspoints consisting of multiple connection wires in the directions X and Y, which are arrayed on both the front and back surfaces of the magnetic shunt plate. A relay terminal plate having a plurality of pairs of coil relay terminals is provided at a central portion of the magnetic shunt plate to divide the coil forms into two groups, such that at least two independent matrices are formed on the magnetic shunt plate.

8 Claims, 15 Drawing Figures

MAGNETICALLY CONTROLLED SWITCHING DEVICE

FIELD OF THE INVENTION

1. Background of the Invention

The present invention relates to a magnetically controlled switching device which is capable of connecting a given input signal line among a plurality of input signal lines to a given output signal line among a plurality of output signal lines.

2. Description of the Prior Art

Usually, a magnetically controlled switching device is used as a speech path switch of electronic switching systems.

Such a magnetically controlled switching device is generally constructed in the form of 8×8 switching matrices from the standpoint of signal line switching/connecting efficiency and producibility. Depending upon the capacity for processing the cells required by the switchboard, however, matrices of 4×8 construction or 4×4 construction will often be necessary, in addition to those of the 8×8 construction.

These various types of matrices are employed in a switching system to meet the functions required by the network of said switching system.

However, it is not economically advantageous to manufacture matrices of various other types such as those of the 4×8 construction and the like, in addition to the matrix of the 8×8 construction, which is most frequently used in the switching system.

SUMMARY OF THE INVENTION

The object of the present invention is to provide a magnetically controlled switching device which eliminates the above-mentioned problems by employing common parts of matrices as much as possible which are produced by common manufacturing steps.

Another object of the present invention is to provide a magnetically controlled switching device which can be fabricated, for instance, with matrices of the 8×8 construction, and which can also be fabricated with switching matrices of the type mounting two matrices of the 4×8 construction.

A further object of the present invention is to provide a magnetically controlled switching device of a special construction for multiple connecting wires which are signal lines.

These objects can be achieved by a magnetically controlled switching device having a magnetic shunt plate with many terminals arrayed along the peripheral portions thereof, a plurality of coil forms located at every crosspoint of a matrix consisting of X and Y coordinates on a plane surrounded by the terminals on the magnetic shunt plate, an X coil control line wound on each of the coil forms in the row of direction X in an alternately reversed manner, both ends of the X coil control line being connected to corresponding terminals of the direction X, a Y coil control line wound on each of the coil forms in the column of direction Y in an alternately reversed manner, both ends of the Y coil control line being connected to corresponding terminals of the direction Y, reed switches accommodated in each of the coil forms, the plane of the contact points of the reed switches corresponding to the magnetic shunt plate, and the reed switches being connected in a matrix consisting of multiple connection wires along the directions X and Y, on both the front and back surfaces of the magnetic shunt plate, the improvement characterized in that a relay terminal plate having a plurality of pairs of coil relay terminals is provided at a central portion of the magnetic shunt plate to divide the coil forms into two groups, the X coil control lines being connected across the coil relay terminals via the pairs of coil relay terminals of the relay terminal plate, and each line being wound in the same direction on the coil frames adjacent to the relay terminal plate via the relay terminal, the X coil control line being cut between pairs of the relay terminals, and multiple connecting wires in the direction X being cut at portions corresponding to the relay terminal plate, in such a manner that at least two independent matrixes are formed on the magnetic shunt plate.

Further features and advantages of the present invention will be apparent from the ensuing description with reference to the accompanying drawings to which, however, the scope of the invention is in no way limited.

DETAILED DESCRIPTION OF THE PREFERRED EMBODIMENTS

Figure 1:
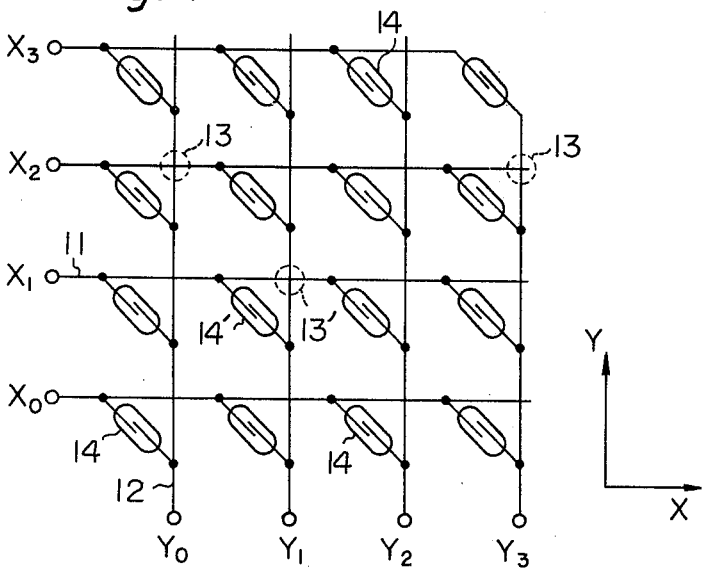
FIG. 1 is a wiring diagram of signal lines used for a magnetically controlled switching device which employs remanent reed switches.

FIG. 1 is a wiring diagram illustrating input signal lines and output signal lines which are crossing each other, and reed switches. This wiring construction has been conventionally known and is also used for the present invention as a constituent element. In FIG. 1, symbols $X_0$ to $X_3$ denote terminals of the input signal lines 11 which run in parallel with the X axis, symbols $Y_0$ to $Y_3$ denote terminals of the output signal lines 12 which run in parallel with the Y axis, reference numeral 13 denotes crossing points (hereinafter referred to as crosspoints) where the input signal lines 11 cross the output signal lines 12, and 14 denotes reed switches which are arrayed at each crosspoint to connect the input signal line 11 to the output signal line 12. Reed pieces of the reed switches 14 are made of a semi-hard magnetic material. FIG. 1 illustrates the construction having a matrix scale of 4×4. In FIG. 1, when a crosspoint 13'' is selected, a reed switch 14' at the crosspoint 13′ is excited to close the contact. Thus, a speech path is selectively formed which leads from the terminal $X_1$ to the terminal $Y_1$.

In order to open and close the contact of the reed switch 14, a predetermined magnetic field should be applied to the reed switch 14 by supplying an electric current to an exciting coil wound on the reed switch.

Figure 2:
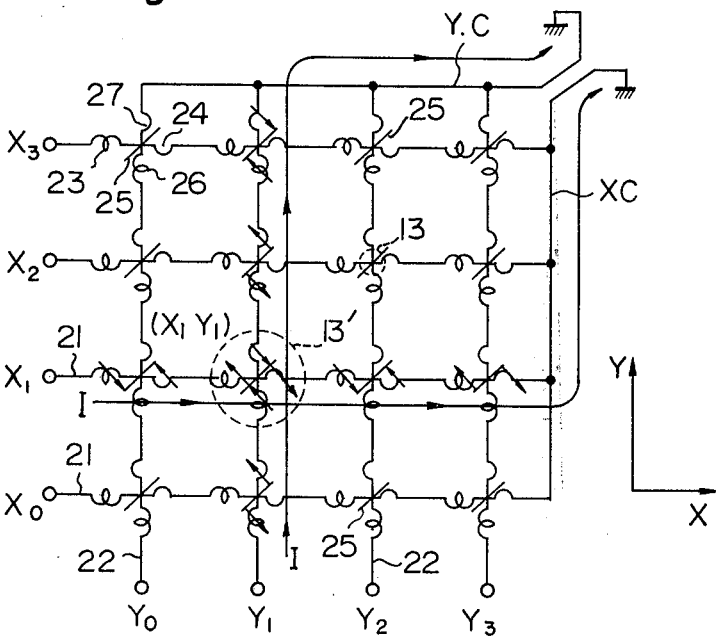
FIG. 2 is a wiring diagram of control lines used for the magnetically controlled switching device.
Figure 3A:
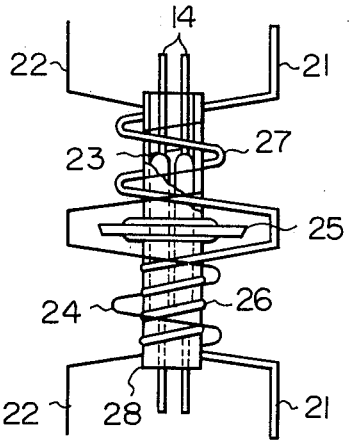
FIG. 3A illustrates in detail a crosspoint of the magnetically controlled switching device.

FIG. 2 is a wiring diagram of X coil control lines and Y coil control lines for closing or opening the contacts of the reed switches illustrated in FIG. 1 by the differential coil exciting method. In FIG. 2, the crosspoints to be controlled correspond to the crosspoint of the speech path system (signal system) illustrated in FIG. 1. Further, with reference to FIG. 2, symbols $X_0$ to $X_3$ denote terminals of the coil controls lines (X exciting coils) 21 which extend in parallel along the X axis direction, and $Y_0$ to $Y_3$ denote terminals of the Y coil control lines (Y exciting coils) 22 which extend in parallel along the Y axis direction. At each crosspoint 13, the X coil control line 21 forms an X exciting coil 23 and an X exciting coil 24 which have a turn ratio of 2 to 1 and which are wound alternately in opposite directions with a magnetic short-circuit plate (magnetic shunt plate) 25 interposed therebetween. The Y coil control line 22 likewise forms, at each crosspoint, a Y exciting coil 26 and a Y exciting coil 27 which are wound at a ratio of 2 to 1 and in alternately opposite directions with the magnetic shunt plate 25 interposed therebetween, for example as illustrated in FIG. 3A. Namely, FIG. 3A is a cross-sectional view illustrating, on an enlarged scale and in a partially cut-away manner, the crosspoint 13′ which is surrounded by a dotted line in FIG. 2. In FIG. 3A, the reference numerals except reference numeral 28 denote the same portions as those of FIGS. 1 and 2, and reference numeral 28 denotes a coil form which contains two reed switches 14.

Figure 3B:
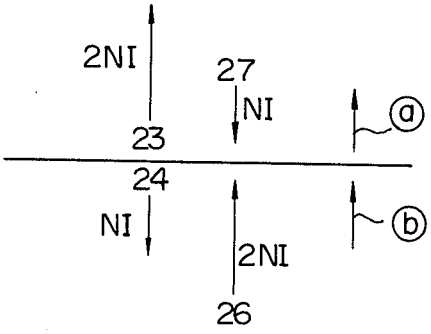
FIG. 3B is a diagram illustrating the electromotive forces of coils at the crosspoint shown in FIG. 3A.

The principle of operation is mentioned below. If now the crosspoint 13′ is selected to form a speech path from the X coil terminal $X_1$ to the Y coil terminal $Y_1$ as mentioned with reference to FIG. 1, a control (exciting) current I (FIG. 2) is fed from the X coil terminal $X_1$ and the Y coil terminal $Y_1$ so that the reed switch 14′ (FIG. 1) provided at the crosspoint 13′ is closed. The other ends of the X coil control lines 21 are short-circuited to each other and are connected to a common X coil control line XC, and the other ends of the Y coil control lines 22 are short-circuited to each other and are connected to a common Y coil control line YC. These common X and Y coil control lines XC and YC are grounded as shown in FIG. 2. Here, if the crosspoint 13′ is selected, the control current I applied through the X coil terminal $X_1$ and the Y coil terminal $Y_1$ flows through a path indicated by an arrow in the drawing, and is grounded. Therefore, the X exciting coils 23, 24 and the Y exciting coils 26, 27 are simultaneously excited at the selected crosspoint 13′ only, so that only selected reed switch 14′ is closed. FIG. 3B illustrates the above operation. The X coil control line 21 and the Y coil control line 22 wound on the reed switch have a turn ratio and winding directions as illustrated in FIGS. 2 and 3A. Accordingly, the electromotive forces appearing in the exciting coils 23, 24, 26 and 27 have the directions and magnitudes as illustrated in FIG. 3B with the magnetic short-circuit plate 25 interposed therebetween. In FIG. 3B, symbol N represents the number of turns of exciting coils 24 and 27 having small number of turns, and I denotes the above-mentioned control current. Here, if only the X coil control current I is permitted to flow, into the exciting coils 23 and 24, only the electromotive forces 23 and 24 of FIG. 3B act upon the reed switch. Magnetic poles of the same polarity appear on the two opposing contacts of the reed switch so that it is completely opened. Similarly, when the Y coil control current I only is permitted to flow to the exciting coils 26 and 27, the contacts are opened. Only when both the X coil control current I and the Y coil control current I are permitted to flow into the exciting coils 23, 24, 26 and 27, the electromotive forces 23, 27 and 24, 26 of FIG. 3B cancel each other, whereby electromotive forces are generated as denoted by a and b. Magnetic poles of dissimilar polarities appear on the contacts such that the reed switch is closed for the first time. Namely, with reference to FIG. 2, only the reed switch which is located at the crosspoint 13′ is closed, and other reed switches are all opened.

With the switching matrix of the magnetically controlled switching device as mentioned above, when the reed switches 14 located at each of the crosspoints are selectively operated by the exciting coils, speech currents or signal currents are allowed to flow from the X coil control terminals $X_0$–$X_3$ and Y coil control terminals $Y_0$–$Y_3$ toward the ground via input signal lines 11, of reed switches 14, output signal lines 12. Usually, the reed switches 14 of the switching matrix do not interrupt the current (speech current or signal current) themselves; the current is allowed to flow or be interrupted by other reed switches in relays connected to the input signal lines 11 or the output signal lines 12. In the magnetically controlled switching device of this type, reed switches 14 of the switching matrix are operated to establish speech paths and then, reed switches in the relays are operated to flow speech current into the speech paths. Thereafter, to interrupt the speech paths the reed switches in the relays are returned to their initial positions, and the reed switches 14 of the switching matrix are returned to their initial position. Owing to the above-mentioned control operation, the wear of contacts can be concentrated onto the reed switches of the relays, which provides an increased advantage from the standpoint of maintenance and economy. That is, as is well known, the contacts of reed switches are most conspicuously worn out by the transfer phenomenon which stems from the arcing during the operation (working operation) of feeding and interrupting the current. Consequently, with the above-mentioned magnetically controlled switching device, contacts of reed switches of the relays are often worn out, but these portions of the device that may develop troubles are specified (which is very convenient from the viewpoint of maintenance). By replacing the reed switches of the relays after a suitable period of use, the switching matrix has a very long life.

Figure 4:
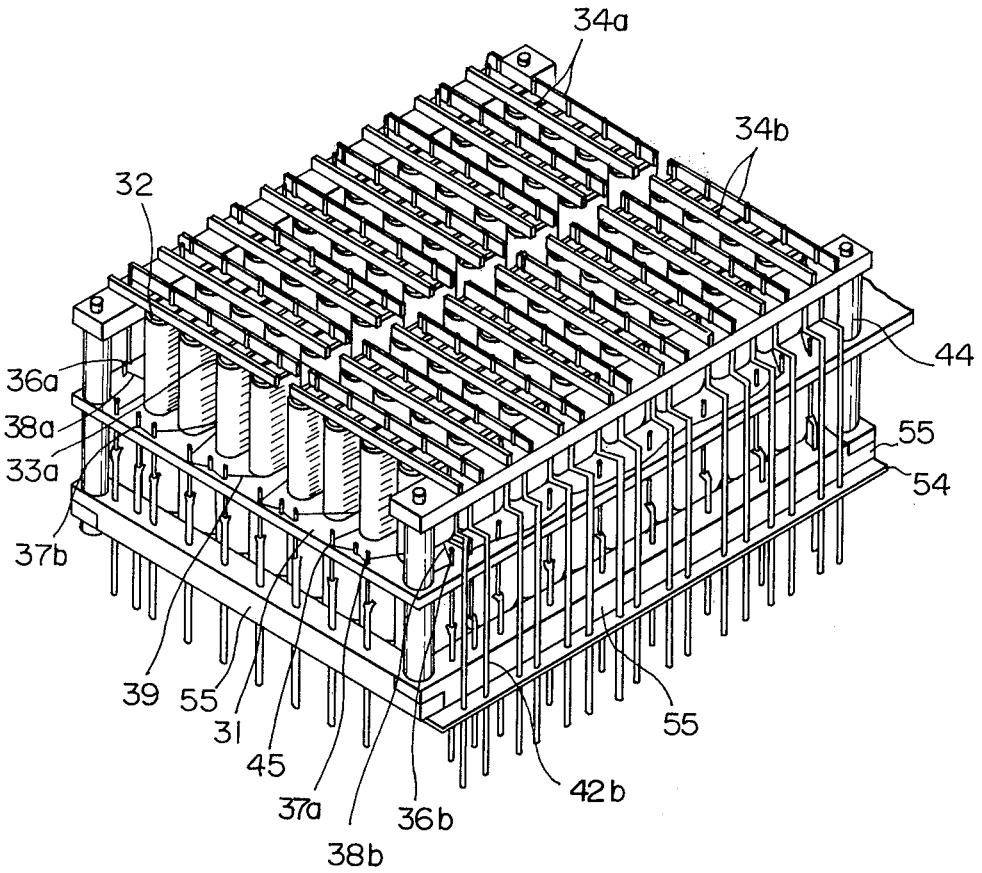
FIG. 4 is a perspective view showing the whole appearance of the device of the present invention.

FIG. 4 is a perspective view illustrating the appearance of the magnetically controlled switching device according to the present invention. FIG. 4 illustrates two matrices of the $4\times8$ construction. However, usually there are two matrices of the $8\times8$ construction mounted on the magnetic shunt plate, so that the four matrices of the $4\times8$ construction are made up in the two matrices of the $8\times8$ construction.

Figure 5:
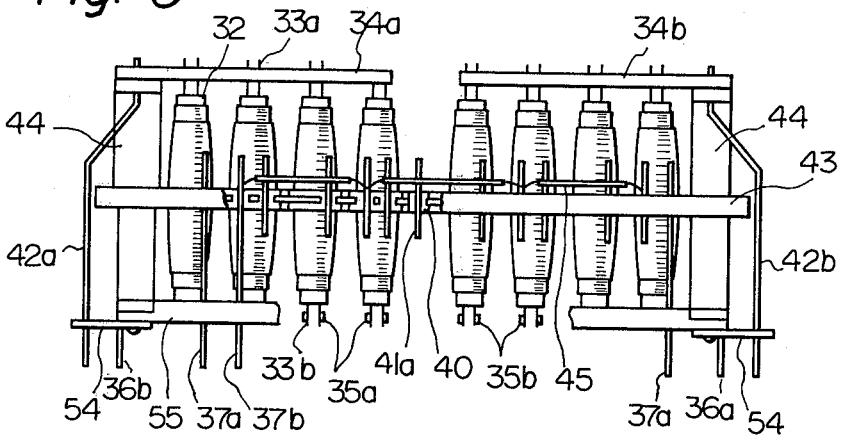
FIGS. 5 and 6 are a front view and a top view respectively of the device of FIG. 4.
Figure 6:
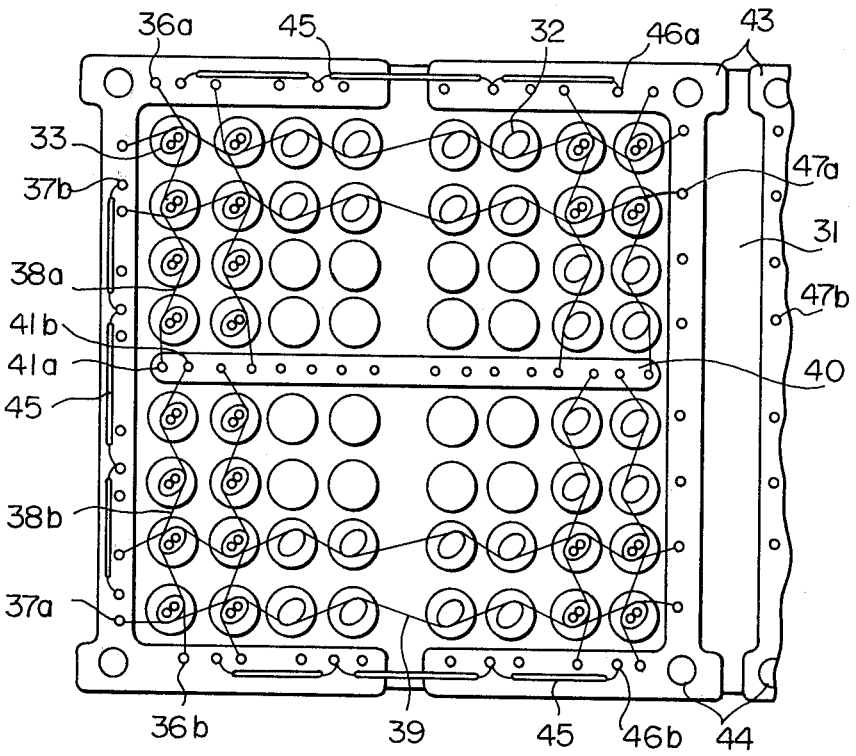

FIG. 5 is a partially cut-away front view of FIG. 4, and FIG. 6 is an upper view of FIG. 1 when multiple connection wires and the like are removed.

These drawings show, a magnetic shunt plate 31, coil frames 32, magnetic self-retaining reed switches 33, reed terminals **33*a*, 33*b* made of a semi-hard magnetic material (composed, for example, of 73 to 93% of cobalt, 1 to 5% of niobium, and the remainder being iron), X strap wires 34a, 34b which serve as multiple connection wires in the direction X and which consist of two pieces of metal plates made of a magnetic material such as permalloy, Y strap wires 35a, 35b which serve as multiple connecting wires in the direction Y and which consist of two pieces of metal plates made of a magnetic material such as permalloy, X terminals 36a, 36b for supplying driving currents, Y terminals 37a for supplying driving currents, common terminals 37b on the side Y to take out driving currents, X coil control lines 38a, 38b Y coil control lines 39, a relay terminal plate 40, pairs of coil relay terminals 41a, 41b, terminals 42a, 42b for taking out signals from the X strap wires 34a and 34b, a terminal plate 43, support poles 44, common connection lines 45, common terminals 46a, 46b in the direction X for taking out driving current, and coil relay terminals 47a, 47b**.

The coil frames 32, relay terminal plate 40, terminal plates 43 and support poles 44 are made of an insulating resin, and are molded onto the magnetic shunt plate 31 as a unitary structure. Terminals 36a, 36b, 37a, 37b, 41a, 41b, 46a, 46b, 47a and 47b are fitted to the terminal plates 43 and relay terminal plate 40.

The two reed switches 33 contained in each coil frame 32 are supported by connecting the X and Y strap wires 34a, 34b, 35a and 35b to the reed terminals 33a, 33b. The X strap wires 34a, 34b are guided via terminals 42a, 42b to the protruded surface of the Y coil terminals 37a, 37b and the Y strap wires 35a, 35b are guided via the terminals (not shown in the drawing) to the same surface of the Y coil terminals, and also X coil terminals 36a, 36b, 46a, 46b are guided to the same surface of the Y coil terminals.

Like the Y strap wires 35a, 35b, the X strap wire 34a or 34b successively connects eight reed terminals 33a in the coil frames and is cut at a portion opposed to the relay terminal plate 40 thereby forming a matrix of the 4×8 construction.

Figure 7A:
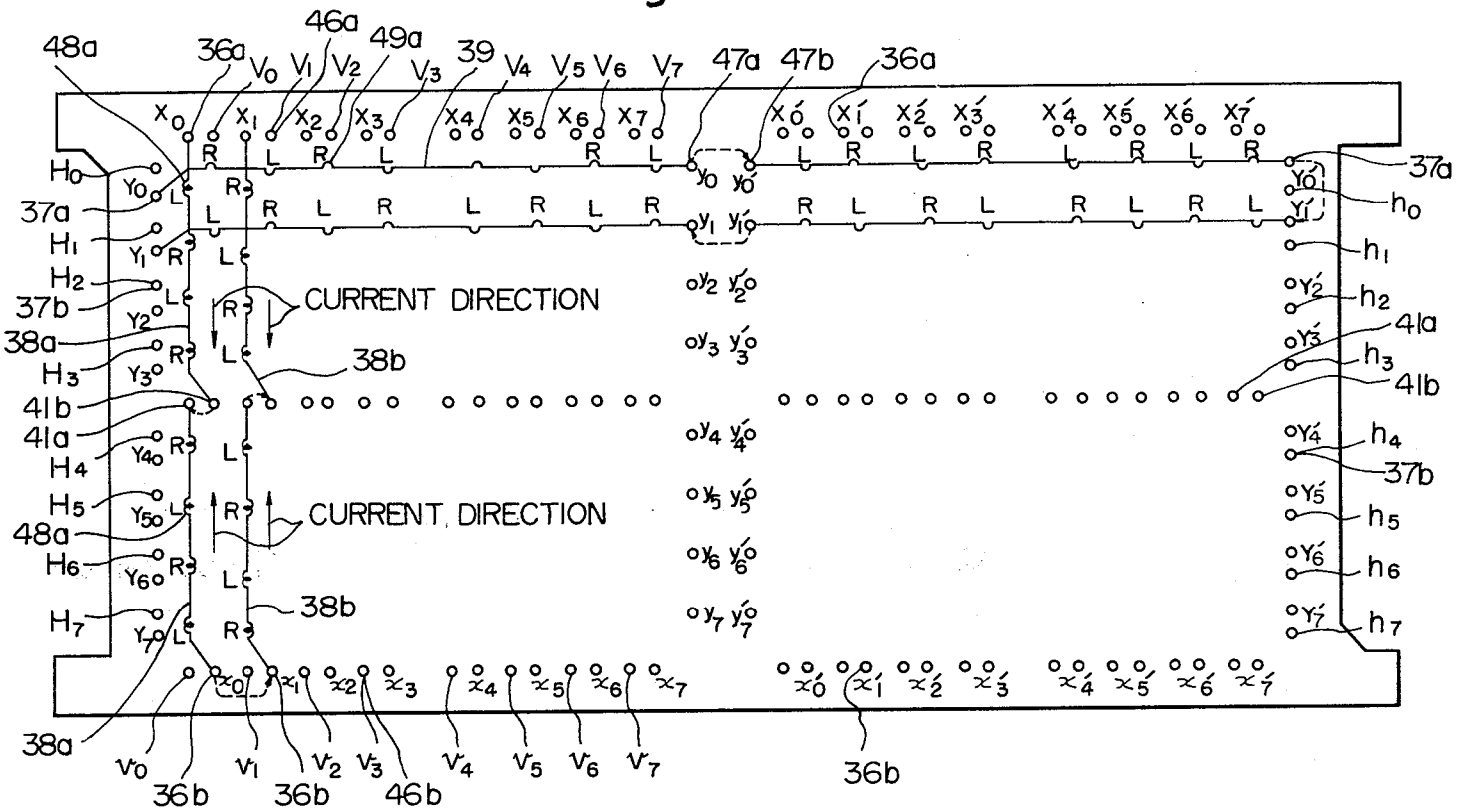
FIGS. 7A and 7B are diagrams illustrating the wound states of control coils.
Figure 7B:
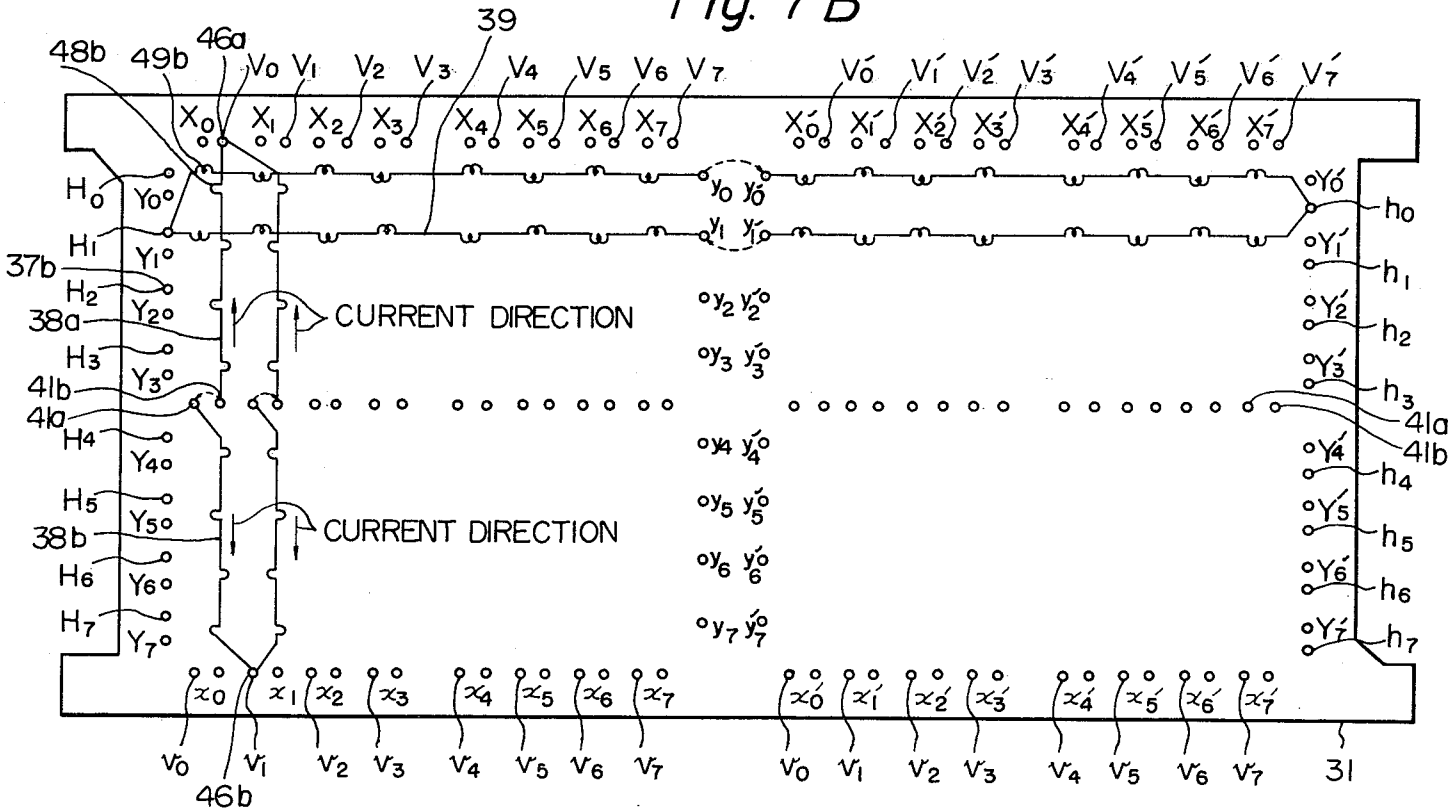

FIGS. 7A and 7B are plan views schematically illustrating the state of forming X and Y coil control lines 38a, 38b and 39 when four matrixes of the 4×8 construction are to be constituted on the magnetic shunt plate 1, wherein FIG. 7A is a diagram showing the front side and FIG. 7B is a diagram showing the back side.

The following is with reference to the X coil control lines 38a, 38b. On the front side as shown in FIG. 7A, a copper wire of which the one end is connected to a terminal $X_0$ of the X input terminal 36a is continuously wound on the coil forms (not shown) of the first column to a number of 2N turns (N denotes the number of turns) to form X coils 48a, this copper wire is connected via the relay terminals 41b and 41a to a terminal $x_0$ of the X coil terminal 36b. The wire then advances from the terminal $x_0$ to a terminal $x_1$ of the X coil terminal 36b and is continuously wound on the coil forms of the second column to a number of 2 N turns to form X coils 48a. The wire then passes through the relay terminals 41a and 41b and is connected to a terminal $X_1$ of the X coil terminal 36a.

The winding direction of the X coils 48a is denoted by R when they are wound in the clockwise direction and by L when they are wound in the counterclockwise direction. As to each column, the coils adjacent to the relay terminals 41a and 41b are all wound in the same direction, and other coils are wound in the opposite directions alternately for each coil form. The wire is wound on the coil forms of the two columns as a unit. Thereafter, the wire is cut between the relay terminal 41a and the relay terminal 41b, and between the X coil terminals 36a and the X coil terminals 36b. Therefore, four sets of X coil control lines 38a, 38b are formed on the front side.

The following is with reference to the Y coil control line 39. On the front side of the magnetic shunt plate, a copper wire of which the one end is connected to a terminal $Y_0$ of the Y coil terminal 37a is continuously wound on the coil forms (not shown) of the first row to a number of N turns so as to form Y coils 49a whose winding direction is alternately reversed. The wire then advances from the relay terminal 47a to the relay terminal 47b as denoted by $Y_0$ and $Y_0'$ and is connected to a terminal $Y_0''$ which is a relay terminal 37a on the other side. The wire then advances from the terminal $y_0'$ to a terminal $Y_1'$ and is folded back to be continuously wound on the coil forms of the second row to form Y coils 49a. The wire then passes via terminals $y_1'$ and $y_1$ and is connected to a terminal $Y_1$. After being wound on the coil forms of the two rows as a unit, the wire is cut between the terminals $y_0$ and $y_0'$ between the terminals $Y_1$ and $Y_1'$, and between the terminals $y_1$ and $y_1'$, thereby to form four sets of Y coil control lines 39 on the front side.

The following is mentioned with reference to FIG. 7B, concerning the X coil control lines 38a, 38b and Y coil control line 39 which are wound on the back side of the magnetic shunt plate.

The coil control lines 38a, 38b are formed in the following manner below. A copper wire of which the one end is connected to a terminal $V_0$ of X coil terminal 46a is continuously wound on the coil forms (not shown) of the first column to a number of N turns thereby to form X coils 48b. The wire then passes from the relay terminal 41b to the relay terminal 41a, and is connected to a terminal $v_1$ of X coil terminal 46b. The wire is then folded back and is continuously wound on the coil forms of the second column to form X coils 48b having N turns. The wire passes from the relay terminal 41a to the relay terminal 41b and is connected to the terminal $V_0$. As to each column, like the X coils 48a in FIG. 7A, the X coils 48b adjacent to the relay terminals 41a and 41b are all wound in the same direction, and other X coils 48b are wound in the reverse direction alternately with respect to each other.

After the copper wire is wound on the coil forms of two columns as a unit, it is cut between the relay terminals 41a and 41b thereby forming four sets of X coil control lines 38a, 38b on the back side of the magnetic shunt plate.

The Y coil control lines 39 are formed as follows. Namely, a copper wire of which the one end is connected to a terminal $H_1$ of Y coil terminal 37b is continuously wound on the coil forms (not shown) of the first row in alternately reversed directions to a number of 2N turns thereby to form Y coils 49b. The wire advances through terminals $y_0$, $y_0'$ and is connected to a terminal $h_0$ of Y coil terminal 37b. The wire is then folded back and is continuously wound again on the coil forms of the second row to form Y coils 49b. The wire runs through terminals $y_1'$ and $y_1$ and is then connected to the terminal $H_1$. After being wound on the coil forms of two rows as a unit, the copper wire is cut between the terminals y and y' to form four sets of Y coils 39 on the back side of the magnetic shunt place.

After the coils have been wound as mentioned above, the X coil terminals 46*a*, 46*b* and Y coil terminals 37*b* are connected by a common connection wire 45 as illustrated in FIG. 6, in order to constitute a magnetically controlled switching device having four matrixes of the 4×8 construction which are mounted on a piece of magnetic shunt plate 31.

Figure 8:
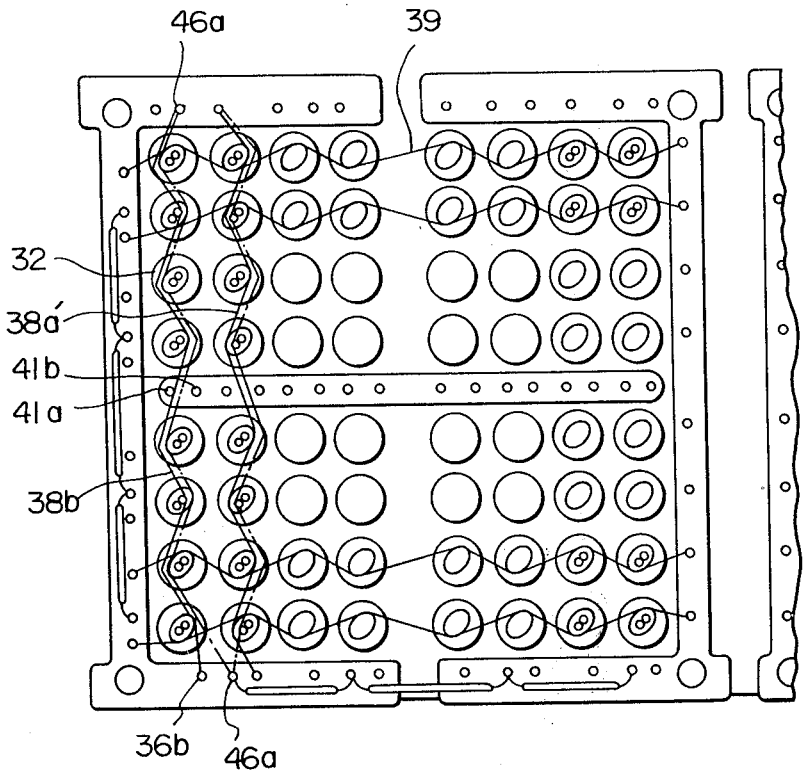
FIG. 8 is a diagram illustrating the state when the device of FIG. 6 is modified into a matrix of 8×8 construction.

The above description has dealt with the case when matrixes of the 4×8 construction are to be formed. However, it is also possible to form two matrices of the 8×8 construction on the magnetic shunt plate 31. Namely, as illustrated in FIG. 8, the Y coil control lines 39 are wound in the same manner as mentioned above. Here, however, the wire in the direction of X is wound on eight coil forms 32 on the front side to form X coil control line 38*b* shown by a solid line, and is connected to the terminal 46*a* without contacting the relay terminals 41*a*, 41*b*. The wire is then folded back and is wound on the coil forms of the second column to form the coil control line 38*a'* also as indicated by a solid line. On the back side, the X coil control lines 38*a'*, 38*b* are wound as indicated by a dot-dash line to constitute control coils. Then the X strap wires are continuously connected to obtain a matrix of the 8×8 construction.

According to the magnetically controlled switching device of the present invention, since the wires are wound as mentioned above, the reed switches at the crosspoints are excited in the alternately reversed directions in both the row and column directions to offset the magnetic interference.

Figure 9A:
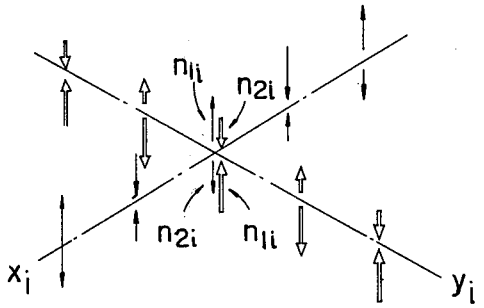
FIGS. 9A and 9B are diagrams showing the magnetic field owing to the multiple connecting wires shown in FIG. 4.

Referring to FIG. 9A, a surface determined by the one dot chain lines $X_i$ and $y_i$ represents the magnetic shunt plate surface, and the length of the arrows (representing the magnitude) and the arrow heads (showing the direction of the magnetic field applied to the reed pieces of each reed switch), are shown along the one dot chain lines.

Figure 9B:
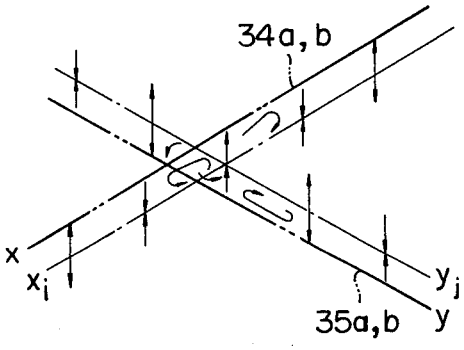

Referring to FIG. 9B, a surface determined by the two dot chain lines x, y represents multiple connecting wires 34*a,b* and 35*a,b*. That is, multiple connecting wire 34*a,b* connects, on the upper part of the magnetic shunt plate, the reed switches which are arranged in the row direction ($x_i$ axis direction) and the multiple connecting wire 35*a,b* connects, on the lower part of the magnetic shunt plate, the reed switches which are arranged in the column direction ($y_i$ axis direction). According to the above-mentioned connections, a closed magnetic path is formed by the reed pieces of the reed switch which is positioned at the crosspoint ($x_i$, $y_i$) multiple connecting wires 34*a,b*; 35*a,b*, the reed pieces of the reed switches which are positioned in the identical row or column adjacent to said reed switch and the magnetic shunt plate. Therefore, when the excitation as shown in FIG. 9A is carried out, the reed pieces positioned at the crosspoint receive the additional magnetic flux from the adjacent reed switches. Then, even if the required magnetomotive force is small, the function of the reed pieces can be effected. When the excitation for restoration of the reed switch is carried out, an additional amount of magnetomotive force equal to the amount of the leakage flux from adjacent reed switches is required and, consequently, the required magnetomotive force for the restoration becomes large. Therefore, the reed switch positioned at the excited crosspoint is not restored with noise.

The matrix of the 4×8 construction which is formed by dividing the matrix of the 8×8 construction according to the embodiment uses the relay terminals 41*a*, 41*b* as terminals for turning back the X coil control lines 38*a*, 38*b*. Therefore, the coil terminals 36*a*, 36*b*, 46*a*, 46*b* of the X coil control lines 38*a*, 38*b* are located at the periphery of the magnetic shunt plate 31. Therefore, the relay terminals 41*a*, 41*b* do not need to be connected to external members, such as a printed circuit board, nor do they need to be formed in an elongated shape.

In general, the above-mentioned coils will be formed by the method of bit winding using an automatic winding machine. In this case, if there are elongated terminals at the center of the magnetic shunt plate through which the bit will pass, the bit collides with the terminal causing the coil to be broken. According to the construction of the invention, however, the terminals positioned at the center of the magnetic shunt plate have a short height, therefore the wire can be easily wound to form control coils maintaining high reliability.

Furthermore, according to the embodiment of the invention, the X coils 48*a*, 48*b* adjacent to the relay terminal plate 40 are symmetrically wound with respect to the relay terminal plate 40, and a driving current is allowed to flow into the X coil control lines 38*a*, 38*b* in a direction of X coil terminals 36*a*, 36*b* toward the relay terminals 41*a*, 41*b*. Therefore, when magnetic fields of the X coils 48*a*, 48*b* are applied to eight reed switches 33 in the column direction, the individual reed switches 33 are excited in alternately reversed directions to offset the magnetic interference.

Moreover, the X strap wires 34*a*, 34*b* which are of the shape of single plates can be simply soldered to the reed terminals 33*a* and cut, presenting very good operation efficiency.

According to the magnetically controlled switching device of the present invention as mentioned above, the strap wires of the divided matrixes are protruded to the back side of the magnetic shunt plate, so that printed circuit boards can be mounted. This is illustrated below in further detail with reference to perspective disassembled views of FIGS. 10A, 10B and 10C.

Figure 10A:
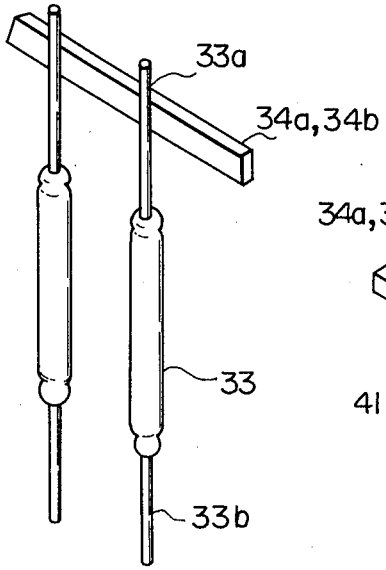
FIGS. 10A, 10B and 10C are diagrams illustrating, on an enlarged scale, the construction for taking out the signals from the device of the present invention.
Figure 10B:
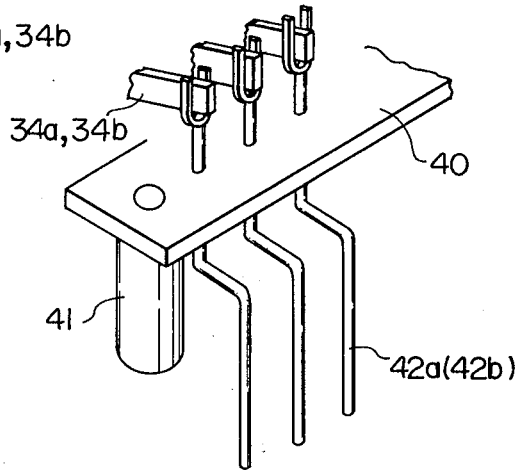
Figure 10C:
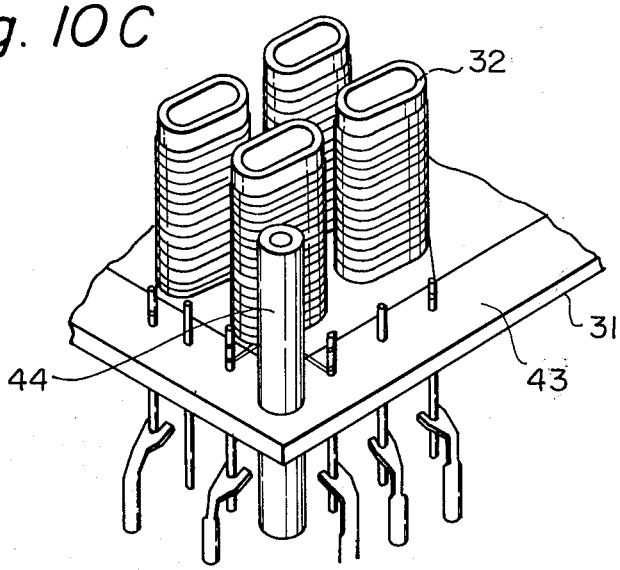

As illustrated in FIGS. 10A, 10B and 10C a terminal plate 40 firmly holding the signal terminals 42*a* (42*b*) which connect to the X strap wires 34*a* (34*b*), are mounted on the support poles 44 of the magnetic shunt plate 31. The terminal plate 40 made of an insulating material has hollow mounting portions 41 which are located on both sides thereof and are formed as a unitary structure. The mounting portions 41 are fitted and secured to support poles 44 which are formed on the upper portion of the magnetic shunt plate 31 as a unitary structure during the step of molding a terminal plate 43. The lower ends of the signal terminals 42*a* (42*b*) penetrate through a positioning plate 54 to determine the positions as illustrated in FIGS. 4 and 5. The positioning plate 54 is screwed to the lower support poles 44 together with a terminal plate 55 which serves to draw the X coil terminals 36*a*, 36*b*, 46*a*, 46*b* and Y coil terminals 37*a*, 37*b* toward the lower surface.

According to the present invention as mentioned above, it can be efficiently obtained by utilizing the existing construction to take out signals from the strap wires of the divided matrices.

Furthermore, it is remarkably economic to manufacture various matrices of this type by employing common manufacturing steps.

What is claimed is:

1. A magnetically controlled switching device comprising:

a magnetic shunt plate with insulated terminals arrayed along peripheral portions thereof, a plurality of coil forms located to define crosspoints of a matrix corresponding to rows and columns along X and Y coordinate directions, respectively, on each of the top and bottom surfaces of said shunt plate, an X coil control line extending along each said row on each said surface of said shunt plate and being wound on each of said coil forms in the respective row in an alternately reversed manner, both ends of each said X coil control line being connected to corresponding ones of said terminals located on said shunt plate near the ends of said rows of coil forms, a Y coil control line extending along each said column on each said surface of said shunt plate and being wound on each of said coil forms in the respective column in an alternately reversed manner, both ends of each said Y coil control line being connected to corresponding ones of said terminals located near the ends of said columns in the direction Y, reed switches accommodated in each of said coil forms, the contact points of said reed switches corresponding to the plane of said shunt plate, a respective connection wire extending along each said row and column on each of said shunt plate to connect in common the respective terminals of said reed switches of each said row and column of each surface of said shunt plate, a relay terminal plate located parallel to said Y coordinate direction between two of said columns of said coil forms, said relay terminal plate comprising a pair of insulated coil relay terminals corresponding to each one of said rows of coil forms, said relay terminal plate dividing said matrix of coil forms on both surfaces of said shunt plate into two groups, each said X coil control line on the top surface of said shunt plate being connected by the respective coil relay terminal of said relay terminal plate to the respective X coil control line on the bottom surface that is wound on the coil forms at identical crosspoints of said matrix, and said X coil control lines in each said row being wound in the same respective direction on the two coil forms adjacent to said relay terminal plate in each respective row, said respective winding direction alternating along said relay terminal plate, said X coil control lines being cut between said pairs of said relay terminals so as not to connect in common the two portions of each said row divided by said relay terminal plate, and each said connecting wire extending along the respective row in the X direction being cut at the portion corresponding to said relay terminal plate to form two independent matrices on said magnetic shunt plate.

2. The device of claim 1 said reed switches comprising magnetic self-retaining reed switches having the reed pieces thereof made of a semi-hard magnetic material.

3. The device of claim 1 each said connecting wire extending in the row and column directions being made of a magnetic material.

4. The device of claim 1 comprising a terminal plate with respective terminals on the end of each said divided connecting wire extending along a respective row that is opposite to the end where said terminal relay strip is located, and means for leading out signals on said connecting wires through the terminals of said terminal plate.

5. The device of claim 1 comprising support poles made of an insulating material at four corners of said magnetic shunt plate, and said terminal plate for leading out the signals comprising means for being fitted and secured to said support poles.

6. The device of claim 1, each said winding of each said X coil control line on the top surface of said shunt plate having 2N turns, where N is an integer, and each of said Y coil control lines on the top surface of said shunt plate having N turns, each said winding of each said X and Y coil control line on the bottom surface of said shunt plate having N and 2N turns, respectively, each said 2N and N turns on each said coil form on each said surface of said shunt plate being wound in opposite directions from each other, the windings of N turns on said coil forms on one surface of said shunt plate being connected by said coil relay terminals on said relay terminal plate to said coil control lines having 2N turns on the other surface of said shunt plate, and said 2N turns on the coil forms of each said reed switch on both sides of said shunt plate being wound in the same direction.

7. The device of claims 1 or 6, each said connecting wire extending in the row and column directions comprising a magnetic material, and the geometry of said connecting wires, and of said alternating windings on the adjacent coil forms at the crosspoints of said matrix, being such that the magnetic fields, from the coil forms in each said group that are adjacent to a reed switch that is being activated, reinforces the magnetic field in the reed switch being activated.

8. The device of claims 1 or 6 said divided groups of coil forms defining two $4\times8$ portions of said crosspoints of said matrix.

* * * * *

UNITED STATES PATENT AND TRADEMARK OFFICE

CERTIFICATE OF CORRECTION

PATENT NO. : 4,330,770

DATED : 18 May 1982

INVENTOR(S) : Kashiwabara et al

It is certified that error appears in the above—identified patent and that said Letters Patent is hereby corrected as shown below:

Col. 1, line 14, "of" should be --in--.

Col. 3, line 12, "crosspoint" should be --crosspoints--;
line 28, "example" should be --example,--.

Col. 4, line 66, delete "," (first occurrence).

Col. 6, line 16, "$Y_o$" " should be --$Y_o$'--;
line 32, delete "below".

Col. 8, line 63, "economic" should be --economical--.

Col. 9, line 28, after "each" insert --surface--.

Col. 10, line 1 of claims 2, 3, 4 and 5, after "1" insert --or 6--.

Signed and Sealed this

*Fourteenth* Day of *September 1982*

[SEAL]

*Attest:*

GERALD J. MOSSINGHOFF

*Attesting Officer*

*Commissioner of Patents and Trademarks*